US005607285A

United States Patent [19]

Eckel

[11] Patent Number: 5,607,285

[45] Date of Patent: Mar. 4, 1997

[54] PUMP DRIVE APPARATUS

[75] Inventor: Hans-Gerd Eckel, Laudenbach, Germany

[73] Assignee: Carl Freudenberg, Weinheim/Bergstrasse, Germany

[21] Appl. No.: 451,403

[22] Filed: May 26, 1995

[30] Foreign Application Priority Data

Jun. 8, 1994 [DE] Germany ..... 44 20 010.2

[51] Int. Cl.[6] ..... F04D 13/02; F04D 29/04

[52] U.S. Cl. ..... 416/170 R; 415/216.1; 415/230

[58] Field of Search ..... 415/70, 113, 122.1, 415/216.1, 229, 230, 231; 416/244 R, 170 R; 417/362

[56] References Cited

U.S. PATENT DOCUMENTS 2,107,090 2/1938 Swennes ..... 415/70

2,113,167 4/1938 Baumheckel ..... 415/113

FOREIGN PATENT DOCUMENTS 58-110898 7/1983 Japan ..... 415/231

*Primary Examiner*—James Larson

*Attorney, Agent, or Firm*—Furgang & Milde, LLP

[57] ABSTRACT

A pump drive apparatus comprises a housing (1) that accommodates a shaft (2) and a pump impeller (3). Both rotate around the same axis (4). The impeller rotates against the housing on at least one bearing (5). There is an eccentric journal (6) on the end of the shaft inside the impeller. The journal rotates in an orbital journal bearing (7). The orbital journal bearing moves in a circle within an eccentric bearing 14 on the impeller, driving the impeller. The orbital bearing tightly encloses the journal. A flexible component (9) prevents the orbital bearing from rotating in, and seals it off from, the housing.

6 Claims, 2 Drawing Sheets

PUMP DRIVE APPARATUS

BACKGROUND OF THE INVENTION

The present invention concerns a pump drive comprising a housing that accommodates a shaft and an impeller, both rotating about a common axis.

A pump drive of this type could be employed, for example, with a pump that circulates water to cool an aircraft engine. A known pump of this type includes a gap sealed with an axial or radial shaft seal. Since it is exposed to wear, neither the seal's tightness nor its life is especially satisfactory.

SUMMARY OF THE INVENTION

The object of the present invention is to provide a pump drive of the aforesaid type that will be tighter and last longer.

This object, as well as other objects which will become apparent in the discussion that follows, are achieved, in accordance with the present invention by a pump drive with the following structure:

The pump impeller rotates within the housing on at least one bearing. There is an eccentric journal at the end of the shaft inside the impeller. The journal rotates within an orbital journal bearing. The journal bearing moves in a circle in an eccentric bearing on the impeller. The orbital journal bearing tightly encloses the journal. A flexible component prevents the journal bearing from rotating with respect to, and seals it off from, the housing.

The impeller in the pump drive in accordance with the present invention accordingly demarcates a hermetically sealed space that is nowhere demarcated by wear-sensitive seals. Consequently, there will be no leakage. There will also be little wear in normal operation. There is accordingly considerable improvement with respect to both sealing capacity, life, and efficiency as compared to conventional pump drives.

The orbital bearing within which the journal rotates can be shaped like a cup. The mouth of the cup can rest against one end of the flexible component. It is practical for the flexible component to be a bellows. The bellows is preferably made of polymer, a thermoplastic or elastomer, or both for example. The flexible component can be made of metal if the metal is thin enough. Metal is particularly practical in centrifugal pumps exposed to severe heat.

The flexible component can be considerably more extended axially than radially if there is enough room to accommodate it. An embodiment in which the flexible component is more extended radially than axially is also possible. Such an embodiment permits the axial length of the pump drive to be reduced.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
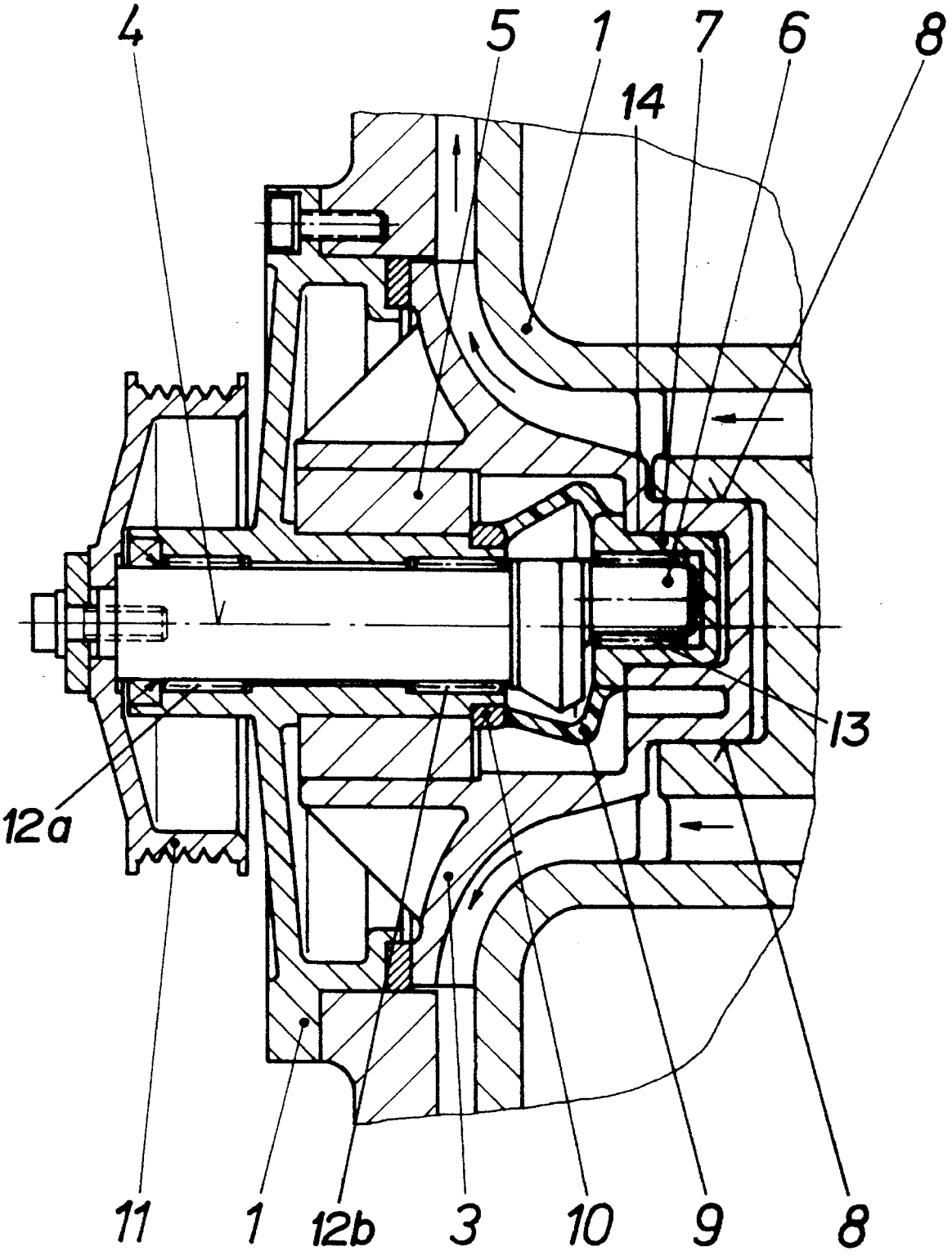
FIG. 1 illustrates one embodiment of a pump according to the present invention drive with a flexible component considerably longer than it is wide.

The preferred embodiments of the present invention will now be described with reference to FIGS. 1 and 2 of the drawings. Identical elements in the two figures are designated with the same reference numerals.

The pump drive illustrated in FIG. 1 comprises a housing 1 that accommodates a shaft 2 and a pump impeller 3. The shaft 2 and its attached pulley 11 rotate about a common axis 4 on roller bearings 12*a* and 12*b*. The impeller 3 rotates with respect to the housing 1 on a main bearing 5. There is an eccentric journal 6 on the end of the shaft 2 inside the impeller 3. The journal 6 is guided and rotates in an orbital journal bearing 7 with the aid of roller bearings 13. The journal bearing 7 moves in a circle within an eccentric bearing 14 on the impeller 3, driving the impeller in a rotary motion within an impeller bearing 8 in the housing 1. The journal bearing 7 is preferably made of plastic. It is cup-shaped and has a hose-shaped flexible cylindrical component 9 vulcanized to its brim. The flexible component 9 is made of rubber. It has radial fins and cannot rotate within the housing 1, which it seals off.

The shaft 2 rotates about the axis 4 when the pump is in operation. The rotation is transmitted to the impeller 3 by the journal 6 and journal bearing 7. The liquid between impeller 3 and housing 1 is forwarded in the direction indicated by the arrows. The flexible component 9 in the illustrated embodiment is secured by a metal ring 10 that rests liquid-tight and impact-resistant against the member of the housing 1 surrounding the shaft 2. A metal or thermoplastic bellows could be employed instead.

Figure 2:
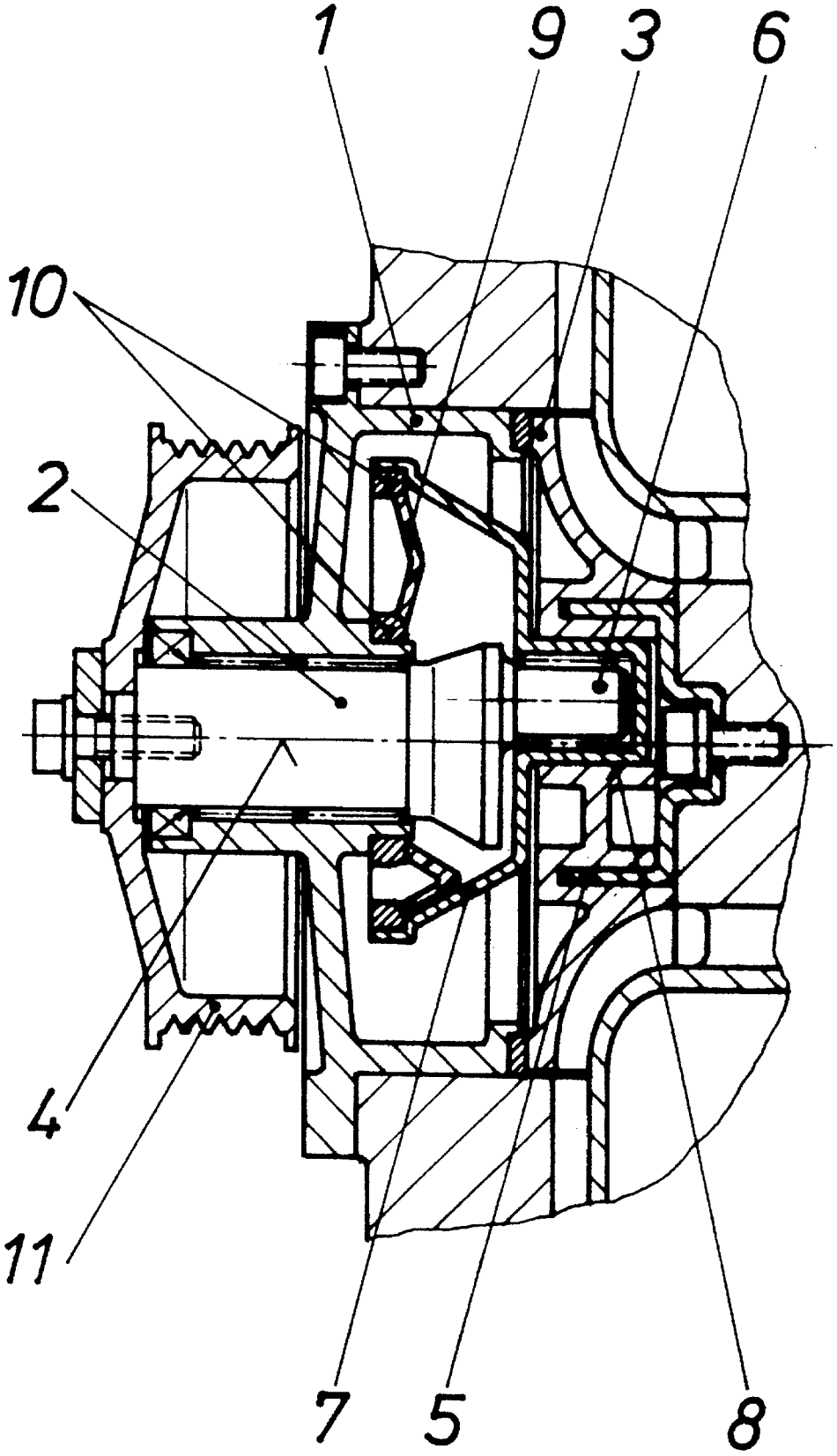
FIG. 2 illustrates another embodiment of pump drive with a flexible component considerably wider than it is long.

The pump drive illustrated in FIG. 2 differs from the embodiment illustrated in FIG. 1 mainly in that the impeller 3 rests in only one bearing 5 and in that the flexible component 9 is considerably more extended radially than it is axially. The component 9 is rubberized cloth and is radially secured inside and outside by metal rings 10. The rings seal it liquid-tight from the mouth of the journal bearing 7 and against the inner portion of the housing 1. The flexible component 9 is subjected to the pressure of the liquid being pumped at only one end. No moving parts are contacted while the pump is in operation. The life of the pump drive is accordingly very long.

There has thus been shown and described a novel pump drive apparatus which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In drive apparatus for a pump which comprises a pump housing, a drive shaft and a pump impeller, said shaft and impeller being arranged concentrically within the housing to rotate about a common axis, the improvement wherein the impeller rotates with respect to the housing on at least one bearing, wherein an eccentric journal is disposed on an end of the shaft inside the impeller, wherein the journal rotates in an orbital journal bearing, wherein the orbital journal bearing moves in a circle in an eccentric bearing on the impeller, wherein the orbital journal bearing tightly encloses the journal and wherein a flexible component prevents the orbital journal bearing from rotating with respect to, and seals it off from, the housing.

2. The drive apparatus defined in claim 1, wherein the orbital journal bearing is cup-shaped.

3. The drive apparatus defined in claim 1, wherein the flexible component includes a bellows.

4. The drive apparatus defined in claim 1, wherein said flexible component has an axial dimension and a radial dimension, said axial dimension being greater than said radial dimension.

5. The drive apparatus defined in claim 1, wherein said flexible component has an axial dimension and a radial dimension, said radial dimension being greater than said axial dimension.

6. The drive apparatus defined in claim 1, wherein said flexible component is made of an elastic material.

* * * * *